US005700161A

United States Patent [19]

Plummer et al.

[11] Patent Number: 5,700,161

[45] Date of Patent: Dec. 23, 1997

[54] TWO-PIECE LEAD SEAL POTHEAD CONNECTOR

[75] Inventors: Leonard M. Plummer; Bartolo L. Leyva, both of Midland, Tex.; Richard T. Rentzel, Broken Arrow, Okla.

[73] Assignee: Baker Hughes Incorporated, Houston, Tex.

[21] Appl. No.: 542,585

[22] Filed: Oct. 13, 1995

[51] Int. Cl.[6] ..... H01R 13/40

[52] U.S. Cl. ..... 439/587; 439/192

[58] Field of Search ..... 439/604, 275, 439/271, 276, 587, 192

[56] References Cited

U.S. PATENT DOCUMENTS

| | | | |
|---|---|---|---|
| 4,073,559 | 2/1978 | Lawson, Jr. . | |
| 4,193,657 | 3/1980 | Slone . | |
| 4,679,875 | 7/1987 | Ramsey . | |
| 4,691,430 | 9/1987 | Wheeler . | |
| 4,859,200 | 8/1989 | McIntosh et al. | 439/604 |
| 5,104,340 | 4/1992 | Elam et al. . | |
| 5,113,101 | 5/1992 | Lie et al. | 310/87 |
| 5,192,229 | 3/1993 | Clark et al. . | |
| 5,221,214 | 6/1993 | Martin . | |
| 5,286,220 | 2/1994 | Watson | 439/276 |
| 5,338,212 | 8/1994 | Oko | 439/148 |

*Primary Examiner*—Khiem Nguyen
*Assistant Examiner*—Eugene G. Byrd
*Attorney, Agent, or Firm*—James E. Bradley

[57] ABSTRACT

An electric submersible pump is provided having a pothead connector for use to connect a downhole cable to an electric motor of the submersible pump. The pothead connector has a tubular housing having an inner end and an outer end. The downhole cable has electrical conductors which are separately covered by insulation layers. Lead sheaths separately extend around each of the insulation layers to encase each the electrical conductors. The downhole cable extends through the inner end and into the tubular housing, and then is electrically connected to the electric motor through the outer end of the tubular housing. An insulator is provided in the outer end of the tubular housing for separating electrical conductors in alignment for mating with a connector mounted to the electric motor. A lead based alloy solder seal is disposed within the tubular housing, intermediately between the inner and outer ends. The solder seal extends between and is wetted to the protective lead sheaths and an interior perimeter of the tubular housing to seal therebetween. An epoxy layer extends between the cable and the interior perimeter of the tubular housing, adjacent to an outer end of the lead based alloy solder seal. A second epoxy layer is disposed within the tubular housing on an inner side of the lead based alloy solder seal, opposite from the outer side. Fasteners secure the tubular housing to the electric motor.

19 Claims, 2 Drawing Sheets

TWO-PIECE LEAD SEAL POTHEAD CONNECTOR

BACKGROUND OF THE INVENTION

1. Field of the Invention

The present invention relates in general to downhole electrical connectors for use in oil field applications, and in particular to a downhole pothead connector for use in corrosive wells.

2. Description of the Prior Art

Prior art electric submersible pumps have been used in oil wells to pump well fluids uphole. These types of prior art submersible pumps include electrical connectors for connecting electric motors of the pumps to electrical conductors of downhole cables. These pumps are often used in corrosive environments such as wells that produce sour gas, hydrogen sulfide ($H_2S$). Electrical connectors for electric submersible pumps typically have elastomeric seals. The hydrogen sulfide encountered in sour gas wells will permeate elastomeric seal materials and deteriorate these seals. This allows the gas to migrate back into the electrical connectors, corroding connectors and seriously reducing the service life of downhole pothead connectors and pumps.

SUMMARY OF THE INVENTION

An electric submersible pump is provided having a pothead connector for use to connect a downhole cable to an electric motor of the submersible pump. The pothead connector has a tubular housing having an inner end and an outer end. The downhole cable has electrical conductors which are separately covered by insulation layers. Lead sheaths separately extend around each of the insulation layers to encase each the electrical conductors. The downhole cable extends through the inner end and into the tubular housing, and then is electrically connected to the electric motor through the outer end of the tubular housing. An insulator is provided in the outer end of the tubular housing for separating electrical conductors in alignment for mating with a connector mounted to the electric motor. A lead based alloy solder seal is disposed within the tubular housing, intermediately between the inner and outer ends. The solder seal extends between and is wetted to the protective lead sheaths and an interior perimeter of the tubular housing to seal therebetween. An epoxy layer extends between the cable and the interior perimeter of the tubular housing, adjacent to an outer end of the lead based alloy solder seal. A second epoxy layer is disposed within the tubular housing on an inner side of the lead based alloy solder seal, opposite from the outer side. Fasteners secure the tubular housing to the electric motor.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
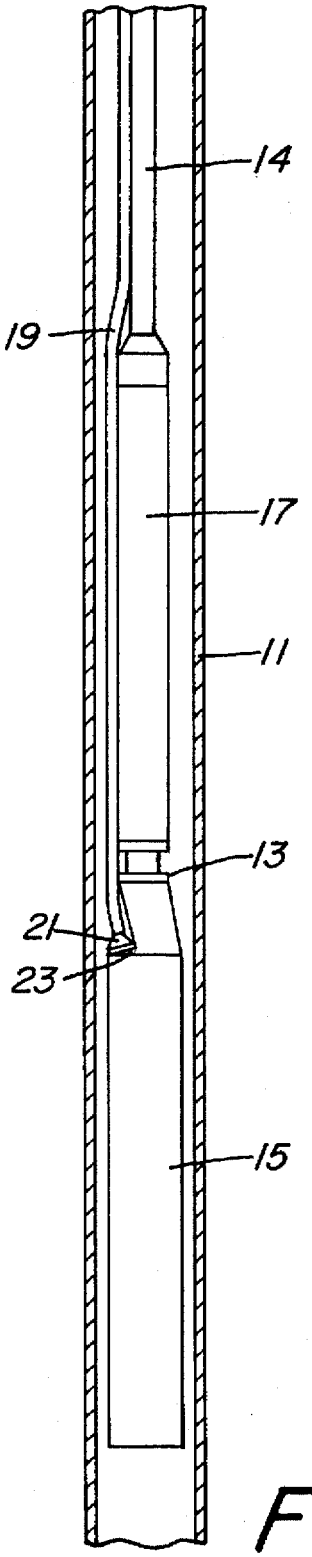
FIG. 1 is an elevational, section view of a well within which an electrical submersible pump is disposed.

FIG. 1 is an elevational section view of well 11 having electric submersible pump 13 disposed therein, mounted to tubing 14. Pump 13 includes an electric motor 15 and a pump section, centrifugal pump assembly 17. Cable 19 extends downhole to provide power to electric motor 15. Pothead connector 21 is mounted to cable 19, and electrically connects and secures the downhole terminal end of cable 19 to housing 23 of motor 15.

Figure 2:
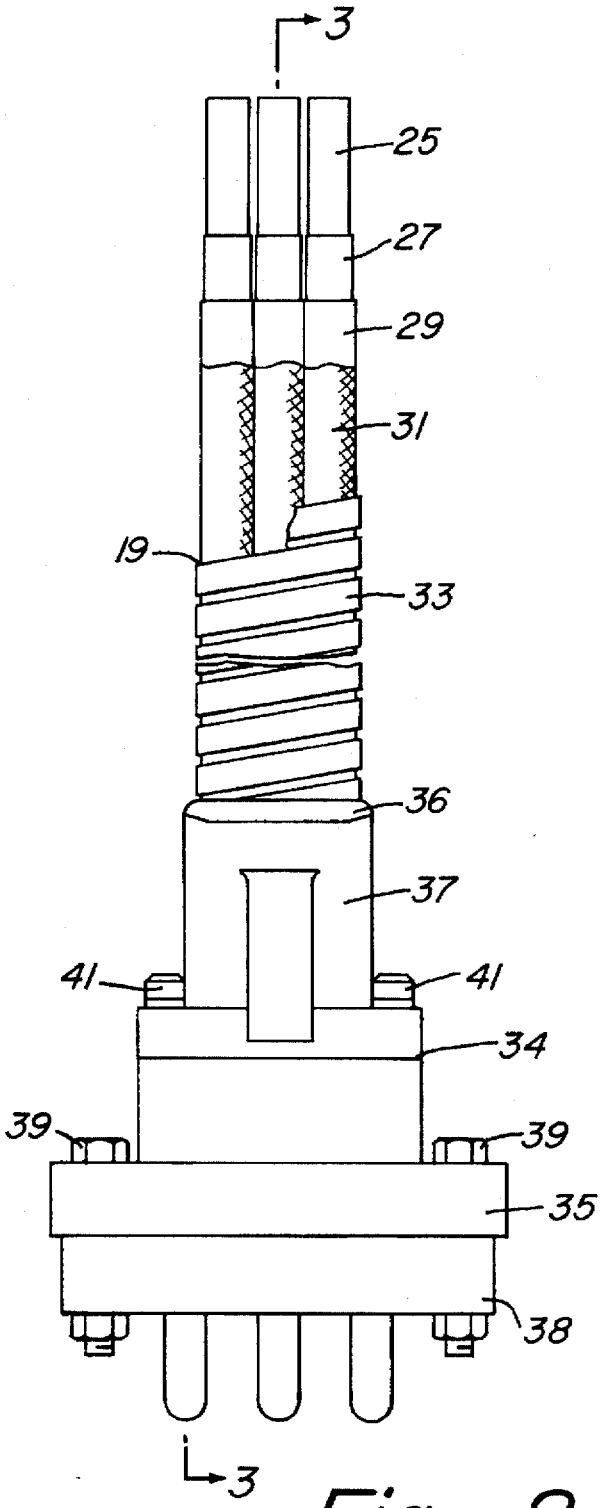
FIG. 2 is a side view of a pothead connector made according to the present invention, and a partial cutaway view of a flat downhole electric cable to which the pothead connector is mounted.

FIG. 2 is a side view of pothead connector 21 and a partial cutaway view of an inner section of cable 19 to which pothead connector 21 is mounted. The upper portion of FIG. 2 provides a cutaway view of cable 19. Cable 19 is preferably a flat cable having an interior core provided by three electric conductors 25. Insulation layers 27 separately extend around conductors 25. Insulation 27 may be of a type for hot temperature well service, such as E.P.D.M. Three lead sheaths 29 separately extend around the exterior of insulation 27 to encase conductors 25. Lead sheaths 29 provide protection against corrosives well fluids, such as sour gas.

Mesh nylon braid 31 extends around lead sheaths 29. Braid 31 may optionally be covered with a tape (not shown). Mesh nylon braid protects lead sheaths 29 as metal armor 33 is being installed. Metal armor 33 is wrapped about mesh nylon braid 31 to provide a hard, abrasion resistant outer protective layer for cable 19. Metal armor 33 is the type for corrosive service, such as may be used in sour gas wells.

Pothead connector 21 is mounted onto the end of flat cable 19. Pothead connector 21 has a tubular housing 34 with an inner end 36 through which cable 19 passes and an outer end 38 through which electrical conductors 25 of cable 19 are electrically connected to electric motor 15. Tubular housing 34 is preferably provided by two opposite end pieces, base 35 and cap 37. Base 35 provides outer end 38 and cap 37 provides inner end 36 of tubular housing 34. Base 35 and cap 37 are made of Niresist alloy, which is a nickel and chromium based alloy for use in sour gas wells. Niresist alloy is available from Sure Case Metals of Burnet, Tex.

Base fastening means 39 includes two bolt type of fasteners which clamp pothead connector 21 to electric motor 15 (shown in FIG. 1). Cap fastening means 41 is provided by two bolt type of fasteners which extend through an outer flange for cap 37 into threaded holes in the rearward face of base 35 for clamping cap 37 to base 35.

Figure 3:
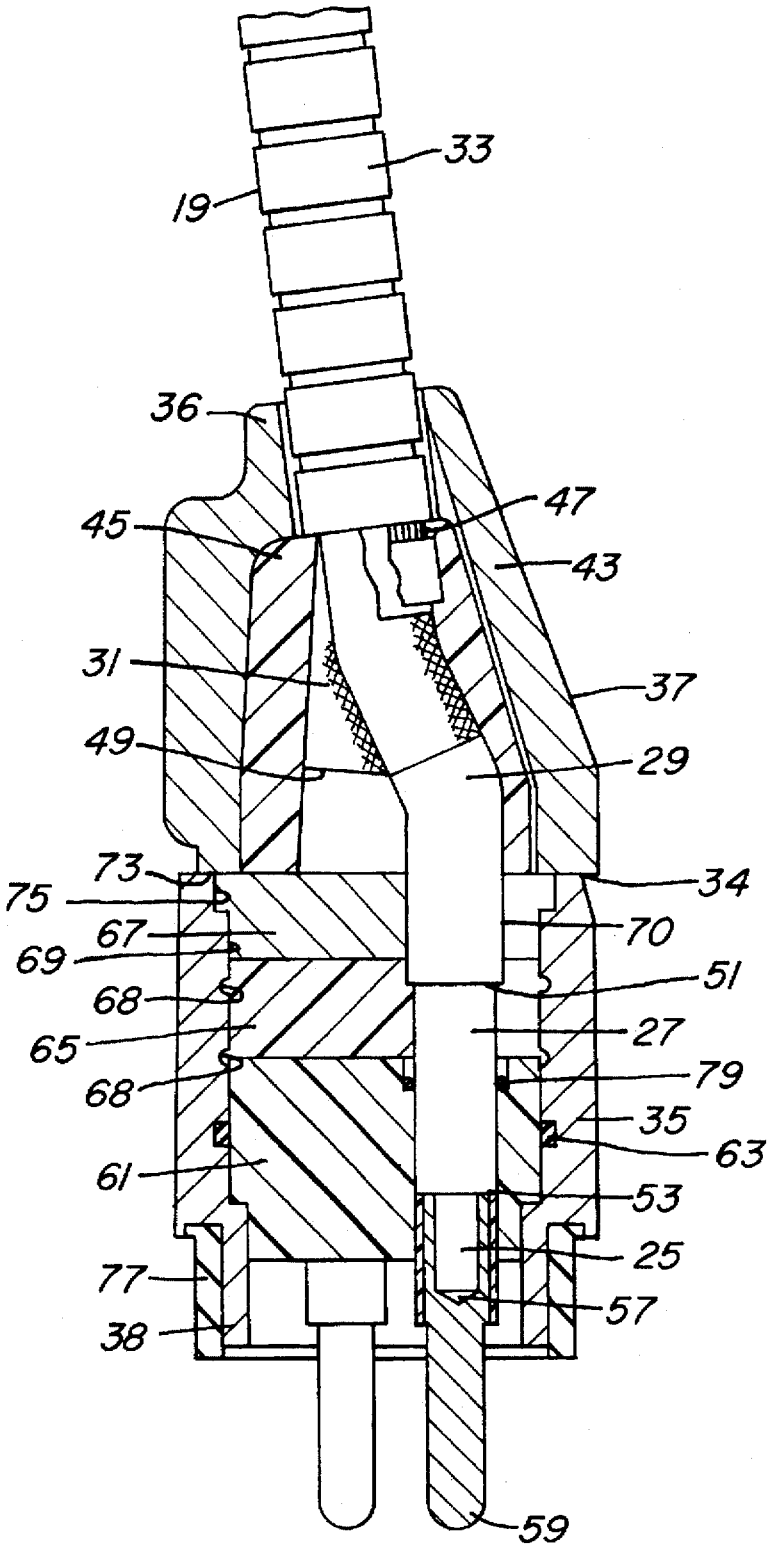
FIG. 3 is a longitudinal section view taken along section line 3—3 of FIG. 2, and depicts the interior of the pothead connecter made according to the present invention, mounted to the terminal end of the flat downhole electric cable.

Referring to FIG. 3, cap 37 of tubular housing 34 has a tapered tubular end 43 which extends around the exterior of armor 33 of cable 19. The interior of cap 37 is filled with epoxy 45, which acts as a retaining means to secure conductors 25 within cap 37 in alignment for extending into base 35. Epoxy 45 is a type of epoxy which is rated for high temperature service. The interior surface of the tapered tubular end 43 has a conical profile, with the inner end periphery being smaller than the outer end periphery. After cap 37 is fastened to base 35 and layer of epoxy 45 is cured, epoxy 45 will provide a conically shaped layer which is aligned within the conical profile of tapered tubular end 43 and prevents movement of cap 37 and base 35 inward over armor 33 of cable 19.

As shown in FIG. 3, armor 33 has been stripped back from the terminal end of cable 19, so that armor 33 has terminal end 47 which is enclosed within the tapered tubular end 43 of cap 37. Preferably, mesh nylon braid 31 will also be stripped to have an end 49 which is enclosed within cap 37 between terminal end 47 of armor 33 and end 51 of lead sheaths 29.

Lead sheaths 29 are preferably stripped from around insulation layers 27 far enough from the terminal end 57 of cable 19 so that sheaths 29 extend through cap 37 and to ends 51, which are disposed at intermediate positions within base 35. Lead sheaths 29 should be stripped no farther from terminal end 57 of cable 19 than would position ends 51 of sheaths 29 within solder layer 67, so that lead sheaths 29 extend at least partially through solder layer 67. This will expose enough of the exterior surface of lead sheaths 29 so that the lead based alloy solder of layer 67 will wet to, that is bond directly to, lead sheaths 29. Lead sheaths 29 will preferably be stripped far enough from the terminal ends of cable 19 so that sheaths 29 will not extend all the way through epoxy layer 65. This will allow at least part of the exterior surfaces of insulation layers 27 to be exposed to the epoxy layer 65, so that the epoxy of layer 65 will bond directly to insulation layers 27.

Ends 53 of electrical insulation layers 27 may be disposed within insulator 61, as shown in FIG. 3, and should extend at least through the solder layer 67 to prevent conductors 25 from shorting. Insulation layers 27 will preferably extend within epoxy layer 65 so that the epoxy of layer 65 will bond directly to insulation layers 27.

At the outer end of base 35, bare electrical conductors 25 provide a terminal end 57 of cable 19. Connector pins 59 have bores which are separately mounted and then soldered over the terminal ends 57 of conductors 25. Connector pins 59 are provided for mating with electrical connectors in electric motor 15 of submersible pump 13 (shown in FIG. 1).

Still referring to FIG. 3, an insulator 61 formed of TORLON, a trademark of AMOCO Performance Products, Inc., is mounted at the outer end 38 of tubular housing 34. O-ring seal 63 is provided around insulator 61. O-ring 63 is made of VITON, a trademark of E. I. Du Pont De Nemours & Company.

An epoxy layer 65 fills in the space between insulator 61 and lead based alloy solder seal 67. Epoxy layer 65 is a type of epoxy rated for high temperature service. Epoxy layer 65 is adjacent to and extends across an outer face of solder seal 67, and preferably bonds to the interior of tubular housing 34 and insulation 27 of electrical conductors 25 when layer 65 is cured. Epoxy layer 65 provides a backing layer for supporting sealing layer 67 of lead based alloy solder against high pressures encountered within wells. Preferably, base 35 has two grooves 68 which provide recesses into which epoxy layer 65 extends to retain epoxy layer 65 within base 35.

Lead based alloy solder seal 67 provides a sealing layer which extends adjacent to the inner face of epoxy layer 65. Tubular housing 34, lead sheaths 51 and lead based alloy solder seal 67 were selected of compatible corrosion resistant materials so that solder seal 67 will wet to the interior perimeter 69 of tubular housing 34 and exterior surface 70 of lead sheaths 51.

Base 35 has a recess 75. Prior to assembly, cap 37 had a lip which extended from end 73 for mating within recess 75 of base 35. In the preferred embodiment, placement of lead based alloy solder seal layer 67 within base 35 typically fills recess 75. The lip which extended from the end of cap 37 was machined off so that end 73 would butt up against the inner end of base 35. In other embodiments, solder layer 67 may be either not placed within recess 75 or cleaned from within recess 75 so that the lip machined from end 73 will fit within recess 75 and not have to be machined off to mount cap 37 to base 35.

Sealing boot 77 extends around a forward lip of base 35 and provides a seal between tubular housing 34 and electric motor 15 of pump 13. Boot 77 is made from E.P.D.M. O-rings 79 separately seal between insulator 61 and bare conductor wires 25 proximate to terminal ends 57. O-rings 79 are made of viton.

With reference to FIGS. 2 and 3, assembly of pothead connector 21 onto cable 19 is now described. Cap 37 is first placed over the terminal end 57 of cable 19 and pushed onto cable 19, away from terminal end 57. Components of cable 19 are then stripped from terminal end 57.

The first component of cable 19 which is stripped from terminal end 57 is metal armor 33. Armor 33 is stripped far enough from terminal end 57 so that electrical connectors 25 may be separated within cap 37 and aligned for extending into base 35, in proper alignment for passing into the holes in insulator 61. Armor 33 is stripped to provide terminal end 47, which is within the tapered end 43 of cap 37.

The next component stripped from cable 19 is mesh nylon braid 31. Mesh nylon braid 31 is stripped from around lead sheaths 29 to provide end 49. Lead sheaths 29 provide a surface to which lead based alloy solder seal 67 will wet. Lead sheaths 51 extend within base 35 beyond the outer ends of lead based alloy layer 67, into the region within base 35 where epoxy layer 65 will be placed.

Lead sheaths 29 will be removed from the terminal end 57 of cable 19 a sufficient distance so that insulation 27 is exposed within the region within base 35 in which epoxy layer 65 is placed. Insulation 27 is preferably made of a material to which epoxy 65 will bond, such as E.P.D.M. Insulation 27 is striped from the terminal ends 57 of conductors 25 at a distance so that electrical conductors 25 will extend within insulator 61. The terminal end 53 of insulation 27 is close enough to the terminal ends 57 of cable 19 to prevent the bare conductors 25 from shorting.

Connector pins 59 are then soldered over the terminal ends 57 of bare electrical conductors 25. Connector pins 59 and the terminal ends 57 of conductors 25 are then placed within insulator 61, with o-ring 79 extending between insulation 27 and insulator 61. Insulator 61 is then placed within base 35, with o-ring 63 sealing between insulator 61 and base 35, and connector pins 59 aligned for mating with electrical connectors mounted within the housing of electric motor 15 (shown in FIG. 1).

A liquid epoxy mixture, a catalyst and a resin, is then poured into the inner end of base 35 for curing to provide epoxy layer 65. Epoxy layer 65 extends around electrical conductors 25, up against the inner face of insulator 61, and preferably bonds to both insulation 27 and the interior of base 35. Epoxy layer 65 will stabilize conductors 25 and provides a seal which is impervious to hydrogen sulfide gas. A space is left within interior perimeter 69 of base 35 for adding lead based alloy solder seal layer 67 next to the inner face of epoxy layer 65.

After epoxy layer 65 is placed within base 35, base 35 is heated to a high enough temperature to assure that lead based alloy solder 67 will wet to base 35. Heating base 35 will also partially cure epoxy layer 65. The portions of lead sheaths 29 to which solder seal 67 will wet may also be heated to assure wetting of the lead based alloy solder of seal 67 to lead sheaths 29. Lead based alloy solder 67 is melted and then placed within interior perimeter 69 of base 35, within the inner end of base 35. Solder seal layer 67 will wet to both the interior perimeter 69 of base 35 and to exterior surfaces 70 of lead sheaths 29 of cable 19. Since lead based alloy solder seal layer 67 wets to and extends across both interior perimeter 69 and exterior surfaces 70, layer 67 provides a fluid barrier through which hydrogen sulfide gas will not permeate.

If alloy solder seal 67 extends into recess 75, it must either be cleaned from within recess 75 by machining, or a lip which extends from end surface 73 of cap 37 must be ground off of cap 37 prior to mounting cap 37 to base 35. Cap 37 then slides outward on cable 19 and mates against the inner end of base 35. Liquid epoxy is then poured into cap 37 to provide epoxy fill layer 45 within cap 37. Epoxy layer 45 holds electrical conductors 25 in position within cap 37. Epoxy layer 45 will seal against gas migration, and will also stabilize conductors 25 to prevent them from moving around and damaging solder seal 67. Cap 37 is then clamped to base 35 by cap fastening means 41.

Epoxy layers 45 and 65 are then cured. Epoxy layer 65 is initially partially cured by heating base 35 to a sufficient temperature to assure that lead alloy solder seal 67 will wet to base 35. Then, epoxy layers 45 and 65 are both cured by heating to 175 degrees fahrenheit (80 deg. C.) for 1.5 hours, and then heating to 275 degrees fahrenheit (135 deg. C.) for 45 minutes. After pothead connector 21 is cooled, sealing boot 77 is secured around a forward lip of base 35 and provides a seal between tubular housing 34 and the housing of electric motor 15 of pump 13.

The present invention has several advantages over prior art electric submersible pumps having pothead connectors in hostile service applications, such as sour gas wells. An electric submersible pump according to the present invention includes a pothead connector with a tubular housing. A layer of lead based alloy solder extends across an interior perimeter of the tubular housing, wetted to the tubular housing and to lead sheaths of electrical conductors of the downhole cable. Lead sheaths separately encase the electrical conductors of the downhole cable. The layer of lead based alloy solder seals between the tubular housing and the lead sheaths encasing the electrical conductors, providing a seal which is impervious to gas migration in hostile environments, such as in hydrogen sulfide in sour gas wells.

An epoxy layer is provided adjacent to the outer face of the leak based alloy solder seal to support the seal against high pressures encountered within wells. This epoxy layer will also seal against gas migration. A second epoxy layer is provided adjacent to the inner face of the layer of lead alloy solder, and also seals against gas migration. Both the inner and outer epoxy layers retain the electrical conductors in alignment for passing through the lead alloy seal and the insulator disk, respectively. The epoxy layers also stabilize the conductors so that they do not move around and damage the lead based alloy layer providing the seal.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

We claim:

1. In an electric submersible pump assembly of the type having a downhole pump section, an electric pump motor and a pothead connector for connecting a downhole cable to the electric pump motor, wherein the pothead connector has a tubular housing and fasteners for securing the tubular housing to the electric pump motor, the tubular housing including an inner end into which the downhole cable extends and an outer end through which electrical conductors of the downhole cable are electrically connected to the electric pump motor, and wherein the downhole cable has insulation layers disposed around each of the electrical conductors and protective lead sheaths extending around the insulation layers to separately encase the electrical conductors, the improvement comprising:

an insulator disk disposed within the tubular housing at the outer end, separating the electrical conductors in alignment for electrically connecting to the electric pump motor;

a lead based alloy solder layer disposed within the tubular housing intermediately between the inner and outer ends, wetted against an interior perimeter of the tubular housing and against the protective lead sheaths to seal therebetween; and an epoxy layer disposed within the tubular housing between the solder layer and the insulator disk and extending from the insulation layers to the interior perimeter of the tubular body.

2. The electric submersible pump assembly of claim 1, wherein the protective lead sheaths extend through the solder layer.

3. The electric submersible pump assembly of claim 1, wherein the insulation layers extend through the epoxy layer, and sealingly terminate in the insulation disk.

4. The electric submersible pump assembly of claim 1, the tubular housing has a cap with a tapered end for closely receiving the cable and which defines the inner end of the tubular housing; and wherein the electric submersible pump assembly further comprises:

a cap epoxy layer disposed within the cap, sealingly surrounding the protective lead sheaths and extending sealingly to an inner perimeter of the cap.

5. In a power cable for supplying power to a downhole electric motor of a well pump, the power cable having a plurality of electrical insulated conductors, each encased within a lead sheath and having an electrical terminal on an end, an improved electrical connector for connection to the motor comprising:

a tubular housing adapted to be fastened to the motor, the housing having an inner end into which the insulated conductors extend and an outer end;

a lead seal layer disposed within the tubular housing between the inner and outer ends, extending to and sealing against an interior perimeter of the housing, the insulated conductors extending through the lead seal layer with their lead sheaths being sealed to the lead seal layer and their terminals located at the outer end for electrical connection with the motor; and an insulation member disposed within the tubular housing between the inner and outer ends and sealing against the interior perimeter of the housing, the insulated conductors extending through and being sealed to the insulation member.

6. The power cable of claim 5, wherein the lead sheaths extend through the lead seal layer.

7. The power cable of claim 5, wherein the lead seal layer comprises solder which wets to the lead sheaths and to the interior perimeter of the housing to form seals therebetween.

8. The power cable of claim 5, further comprising a plurality of fabric braids, each surrounding one of the lead sheaths, the fabric braids terminating inward from the lead seal layer.

9. The power cable of claim 5, further comprising a first epoxy layer disposed within the housing between the lead seal layer and the insulation member, the first epoxy layer extending to the interior perimeter of the housing; and wherein the insulated conductors extend sealingly through the first epoxy layer; and the lead sheaths of the insulated conductors extend into and terminate within the first epoxy layer.

10. The power cable of claim 9, wherein:

each of the insulated conductors has an insulation layer which extends into and terminates sealingly in the insulation member.

11. The power cable of claim 5 wherein the lead seal is formed of a lead alloy based solder material.

12. The power cable of claim 9, further comprising a second epoxy layer located between the lead seal and the inner end of the housing, the second epoxy layer sealingly surrounding the insulated conductors and the lead sheaths and extending sealingly to the inner perimeter of the housing.

13. An electrical connector for connecting a power cable to a downhole electric motor of a well pump, the power cable having a plurality of electrical insulated conductors, each encased within a lead sheath, the electrical connector comprising:

a tubular housing, the housing having an inner end into which the insulated conductors extend and an outer end adapted to couple to the motor;

a lead seal layer disposed within the tubular housing between the inner and outer ends, sealing against an interior perimeter of the housing, the insulated conductors extending through the lead seal layer with their lead sheaths being sealed to the lead seal layer;

an insulation member disposed within the tubular housing between the inner and outer ends and sealing against the interior perimeter of the housing, the insulated conductors extending through and being sealed to the insulation member; and a first epoxy layer disposed within the housing between the lead seal layer and the insulation member, the first epoxy layer extending to the interior perimeter of the housing and sealingly surrounding the insulated conductors.

14. The power cable of claim 13, wherein the lead sheaths extend through the lead seal layer and sealingly terminate in the first epoxy layer.

15. The power cable of claim 13, wherein the lead seal layer comprises solder which wets to the lead sheaths and to the interior perimeter of the housing to form seals therebetween.

16. The power cable of claim 13, further comprising a plurality of fabric braids, each surrounding one of the lead sheaths, the fabric braids terminating inward from the lead seal layer.

17. The power cable of claim 13, wherein:

each of the insulated conductors has an insulation layer which extends through the first epoxy layer into and terminates sealingly in the insulation member.

18. The power cable of claim 13 wherein the lead seal is formed of a lead alloy based solder material.

19. The power cable of claim 13, further comprising a second epoxy layer located between the lead seal and the inner end of the housing, the second epoxy layer sealingly surrounding the insulated conductors and the lead sheaths and extending sealingly to the inner perimeter of the housing.

* * * * *